United States Patent [19]

Kawamura

[11] Patent Number: 4,864,987

[45] Date of Patent: Sep. 12, 1989

[54] HEAT INSULATING ENGINE

[75] Inventor: Hideo Kawamura, Samukawa, Japan

[73] Assignee: Isuzu Motors Limited, Tokyo, Japan

[21] Appl. No.: 283,816

[22] Filed: Dec. 13, 1988

[30] Foreign Application Priority Data

Dec. 14, 1987 [JP] Japan ..... 62-314184

[51] Int. Cl.[4] ..... F02B 75/08

[52] U.S. Cl. ..... 123/193 CP; 123/668

[58] Field of Search ..... 123/668, 669, 193 C, 123/193 CP, 193 H, 272, 270

[56] References Cited

U.S. PATENT DOCUMENTS

| | | | |
|---|---|---|---|
| 1,857,077 | 5/1932 | Adamson | 123/669 |
| 3,081,754 | 3/1963 | Georges | 123/668 |
| 4,074,671 | 2/1978 | Pennila | 123/668 |
| 4,245,611 | 1/1981 | Mitchell et al. | 123/669 |
| 4,328,772 | 5/1982 | Heydrich et al. | 123/669 |
| 4,538,562 | 9/1985 | Matsui et al. | 123/669 |
| 4,590,901 | 5/1986 | Mizuhara | 123/669 |
| 4,646,707 | 3/1987 | Pfefferle | 123/668 |
| 4,796,572 | 1/1989 | Heydrich | 123/668 |

FOREIGN PATENT DOCUMENTS

| | | | |
|---|---|---|---|
| 2757668 | 7/1978 | Fed. Rep. of Germany | 123/669 |
| 0053629 | 3/1983 | Japan | 123/668 |
| 0170446 | 9/1984 | Japan | 123/669 |

*Primary Examiner*—David A. Okonsky

*Attorney, Agent, or Firm*—Browdy and Neimark

[57] ABSTRACT

In a heat insulating engine of this invention, the piston head is made up of a retainer body, a heat insulating member mounted on the retainer body, and a thin ceramic member formed over the upper surface of the heat insulating member exposed to the burning gas and over the circumference of the former two members. The retainer body is mounted to a piston skirt through a heat insulating gasket. The cylinder is so constructed that the piston head does not contact the cylinder liner upper portion of the head-liner but can contact the cylinder liner lower portion. When the piston is situated close to the top dead center, the heat insulating structure of the combustion chamber prevents heat from being released from the piston head. When the piston is pushed down, the heat of the piston head is released through the cylinder liner lower portion, rapidly reducing the temperature in the combustion chamber, preventing fresh air taken in from thermally expanding and therefore preventing a reduction in the air intake efficiency.

15 Claims, 3 Drawing Sheets

HEAT INSULATING ENGINE

BACKGROUND OF THE INVENTION

1. Field of the Invention

This invention relates to a heat insulating engine formed of ceramic materials.

2. Description of the Prior Art

A conventional heat insulating engine that uses heat insulating members or heat resistant members formed of ceramic material is disclosed in the Japanese Patent Application Laid-Open No. 122765/1984 filed by this inventor. This is briefly explained by referring to FIG. 5. The heat insulating engine 40 described in the above patent application has fitted inside a cast cylinder head 43 a ceramic liner head 41 which has a cylinder liner 42. The liner head 41 consists of a cylinder head inner wall 52 and a cylinder liner upper portion 51, integrally formed in one piece. The cylinder head inner wall 52 is the portion most exposed to hot and high pressure gas during one cycle of engine and also the one through which heat dissipates most. A piston head 44 is formed of silicon nitride with a recess 45 at the center and with a step 46 formed at the lower end circumference to position a piston body 47 and prevent its dislocation. The piston head 44 has a bolt insertion hole in the center recess 45 to secure the piston body 47 thereto. The piston body 47 has at the upper end circumference a step 48 to receive the lower end circumference of the piston head 44. The piston body 47 also has its top center portion raised and the upper surface of the raised portion 49 is placed in contact with the underside of the piston head 44. Then, the piston head 44 and the piston body 47 are held together by bolt 50. The piston head 44 is formed thick and in one piece.

The Japanese Patent Application Laid-Open No. 119892/1986 discloses a heat insulating structure of heat engine in which a hollow portion between metal structure and a ceramic heat insulating wall is filled with a heat convection prevention material such as ceramic fibers and stainless steel fibers. This heat insulating structure of heat engine has a heat reflection plate of heat resistant metal on the inner wall of the hollow portion. The piston of this structure has a piston head formed thick and in one piece, as with the preceding example.

With the above heat insulating engine members, such as piston, that use ceramic materials for heat insulating or heat resistant members, however, it is very difficult to provide a sufficient heat insulating performance. This is because the ceramic member is exposed to high temperatures in the combustion chamber and thus undergoes a heat shock, which gives rise to a problem in terms of strength of the ceramic member. On the other hand, when the thickness of the ceramic member on the wall is increases for better heat insulation, the heat capacity will increase, so that fresh air drawn into the cylinder during the intake stroke receives greater amount of heat from the combustion chamber and therefore is heated to higher temperatures, reducing the air intake efficiency, making it difficult for a sufficient amount of air to be taken in. On the contrary, the heat insulation must be improved during the compression stroke.

In the heat insulating engines described in the foregoing patent applications (Japanese Patent Application Laid-Open Nos. 122765/1984 and 119892/1986), the ceramic piston head is formed with a recess and thus required to have a very large thickness to have a sufficient strength. On the other hand, to improve the air intake efficiency the heat capacity of the piston head must be made as small as possible. The piston head has these two contradicting requirements and therefore has inherent problems similar to those mentioned above.

This is explained below. FIG. 4 is a graph showing the temperature variations of the piston head with the lapse of time during engine operation. In engines with its piston head formed monolithic or in one piece, like the foregoing heat insulating engines, the temperature reduction in the power stroke and exhaust stroke is small and a high temperature state continues, as indicated by a broken line M in the graph of FIG. 4. The temperature in the combustion chamber during the intake stroke is not sufficiently low so that fresh air is not easily drawn into the combustion chamber in sufficient quantity, reducing the air intake efficiency.

SUMMARY OF THE INVENTION

The major object of this invention is to provide a heat insulating engine that overcomes the above problems. The heat insulating engine of this invention is characterized as follows. It has a high heat insulating performance by taking advantage of the fact that the gas temperature and pressure become very high and the amount of heat transfer increases when the piston is close to the top dead center. The surface of the piston head which is exposed to burning gas and thus heated to high temperatures is so formed that its heat capacity is as small as possible. When the piston is situated near the top dead center, the heat insulating portion of the piston head is surrounded by the heat insulating portion of a cylinder liner upper portion to form a heat insulating structure that prevents release of heat. When the piston is pushed down, the piston head comes into contact with a cylinder liner lower portion to rapidly release the heat of the piston head. As a result, during the intake stroke the temperature of the piston head is already as low as almost the temperature of the cylinder liner lower portion. This means the temperature of the combustion chamber is also sufficiently low to prevent heat expansion of fresh air drawn in, thus preventing reduction in the air intake efficiency and improving the cycle efficiency.

Another object of this invention is to provide a heat insulating engine which is characterized in: that a piston head consists of a retainer body secured to a piston skirt, a heat insulating member mounted on the upper surface of the retainer body, and a thinned ceramic member formed on the top of the heat insulating member and around the circumference of the heat insulating member and the retainer body; that the retainer body is mounted to the piston skirt through a heat insulating gasket; and that the inner diameter of a cylinder liner upper portion is larger than that of a cylinder liner lower portion so that the piston head circumferential portion does not contact the cylinder liner upper portion but can contact the cylinder liner lower portion.

A further object of this invention is to provide a heat insulating engine which is characterized in: that a head-liner, which consists of a cylinder liner upper portion and a head lower portion with an intake port and an exhaust port, is formed in one piece and made of ceramic material such as silicon nitride ($Si_3N_4$) or silicon carbide (SiC); that a heat insulating liner is applied to the head-liner on the side of the combustion chamber with a heat insulating member interposed therebetween; and that a cylinder liner lower portion, which is located below the cylinder liner upper portion, is formed of ceramic material such as silicon nitride ($Ni_3N_4$) or silicon carbide (SiC), with a heat insulating gasket interposed between the cylinder liner upper portion and the cylinder liner lower portion.

A still further object of this invention is to provide a heat insulating engine which is characterized in: that a thinned member mounted on the piston head consists of a thinned plate portion, disposed on a heat insulating member and exposed to burning gases, and a thinned circular portion integrally formed with the thin plate portion, covering the circumferential portion of a retainer body and of the heat insulating member; and that the thinned member is integrally formed, using ceramic material such as silicon nitride ($Si_3N_4$) or silicon carbide (SiC), by chemical vapor deposition with the retainer body and the heat insulating member.

A still further object of this invention is to provide a heat insulating engine which is characterized in that even if a large amount of intake air comes into contact with the thinned ceramic plate portion, the thinned ceramic plate portion with a small heat capacity is rapidly cooled by fresh air immediately upon contact, thereby preventing expansion of the intake air and therefore reduction in the air intake efficiency, and improving the cycle efficiency. The thinner the thinned ceramic member that forms the surface of the piston head exposed to burning gases, the better the thinned ceramic member can follow up the gas temperature changes. Another advantage of forming the thinned portion as thin as possible is that the wall temperature variation that occurs as the temperature in the combustion chamber goes high and low is larger than the wall temperature variation of a thicker thinned member. This means that the temperature difference between the burning gas and the combustion chamber wall, i.e., the thinned ceramic member, is small, reducing the amount of heat transferred and therefore the amount of heat imparted to the incoming fresh air. Furthermore, since the wall of the combustion chamber is highly heat-resistant, there is no problem in terms of strength when it receives a heat shock.

DETAILED DESCRIPTION OF THE EMBODIMENT

Now, by referring to the accompanying drawings, we will describe in detail a heat insulating engine embodying this invention.

Figure 1:
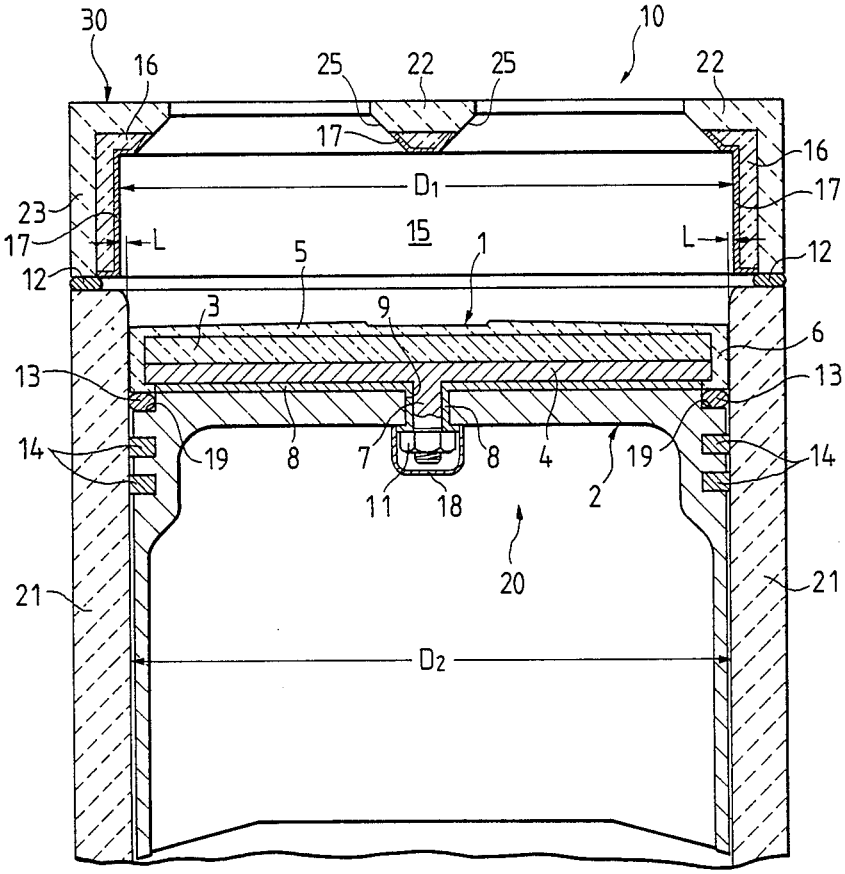
FIG. 1 is a cross-sectional view of a heat insulating engine as one embodiment of this invention.

In FIG. 1, the heat insulating engine as one embodiment of this invention is generally shown by a reference numeral 10. The heat insulating engine 10 consists mainly of: a piston 20 made up of a piston head 1 and a metal piston skirt 2; a head-liner 30 made of ceramic material such as silicon nitride, fitted into a hole formed in a cylinder head (not shown), the cylinder head being formed of a metal casting and having an intake port and an exhaust port; and a cylinder liner lower portion 21 made of ceramics such as silicon nitride, located at the lower portion of the cylinder liner. The head-liner 30 consists of a cylinder liner upper portion 23 and a head lower portion 22, these two portions being integrally formed and having a heat insulating liner 17 attached thereto on the side of the combustion chamber 15 with a heat insulating material 16 interposed between the headliner 30 and the heat insulating liner 17. The head-liner 30 is formed with an intake port and an intake valve seat 25 and with an exhaust port and an exhaust valve seat 25. The cylinder liner upper portion 23 is mounted on the cylinder liner lower portion 21 through a heat insulating gasket 12. The piston 20 reciprocates in the cylinder formed by the cylinder liner upper portion 23 and the cylinder liner lower portion 21. A piston head 1 of the piston 20 has a retainer body 4 on which a heat insulating material 3 is mounted, with those upper surface and circumference of the piston head 1 exposed to burning gases covered with a thinned ceramic member. That is, on the upper surface of the piston head 1 facing the combustion chamber 15 and exposed to burning gases is mounted a flat, thinned plate portion 5 of ceramic material. Around the circumference of the piston head 1 is provided a thinned circular portion 6 made of ceramic material. The piston head 1 of such a construction is secured to a piston skirt 2 by first interposing a heat insulating gasket 8 between the retainer body 4 and the piston skirt 2, inserting a mounting boss 7 formed at the center of the retainer body 4 into a mounting hole 9 formed at the center of the piston skirt 2, and fastening a nut 11 on the mounting boss 7.

In heat insulating engine 10 of the above construction, the inner diameter Dl of the cylinder liner upper portion 23 is formed larger than the inner diameter D2 of the cylinder liner lower portion 21 so that there is a step forming a gap L between the cylinder liner upper portion 23 and the cylinder liner lower portion 21. Hence, the piston head 1, as the piston reciprocates in the cylinder liner, contacts the piston head lower portion 21 but does not contact the piston head upper portion 23. The head-liner 30 has a one-piece structure made up of the cylinder liner upper portion 23 and the head lower portion 22 and is designed to insulate heat only during a heat producing period in which fuel is burned. The combustion chamber 15 formed by the head-liner 30 and the flat, thinned ceramic plate portion 5 of the piston head 1 has an optimum construction for the heat insulating engine.

The retainer body 4 of the piston head 1 of the piston 20 has the mounting boss 7 at the center and is formed of such materials as cermet and metal that are almost equal in thermal expansion coefficient to ceramics and have high strength and relatively high Young's modulus. The heat insulating piston 20 is required to receive the compression force produced by explosion in such a way that the compression force is uniformly distributed over and sustained by the heat insulating member 3 made of such material as potassium titanate. For this reason, the surface of the retainer body 4 facing the combustion chamber 15 is formed flat, and so is the thinned ceramic plate portion 5. The piston head 1 has no combustion chamber formed therein and is formed flat on the surface facing the combustion chamber 15. The piston head 1 is securely engaged with the piston skirt 2 with heat insulating gaskets 8 and 13 interposed, the heat insulating gasket 13 being installed at a step 19 formed around the upper circumference of the piston skirt 2. The piston head 1 is then pressed against the piston skirt 2 by inserting the mounting boss 7 of the piston head 1 into the center mounting hole 9 of the piston skirt 2 and by tightening the nut 11. The thinned plate portion 5 at the top of the piston head 1 is formed of ceramic material such as silicon nitride and silicon carbide by chemical vapor deposition so that its thickness will be equal to or less than about 1 mm. On the circumferences of the thinned plate portion 5, retainer body 4 and heat insulating gasket 8 is formed a thinned circular portion 6 of the similar ceramic material to that of the thinned plate portion 5, through the chemical vapor deposition. The heat insulating material 3 of the piston head 1 may be formed of such materials as potassium titanate whiskers, zirconia fibers, carbon fibers, and alumina fibers. It performs a function of heat insulation and also serves as a structural member to resist a pressure acting on the thinned plate portion 5 during the power stroke. The heat insulating member 16 on the head-liner 30 is also formed of similar materials and performs the heat insulating function. The heat insulating gaskets 8, 12, 13 may be formed by laminating potassium titanate paper, or by forming in one piece or laminating the mixture of potassium titanate whiskers and organic binder, or by forming into shape the mixture of potassium titanate whiskers, alumina fibers and organic binder. Ceramic fibers such as zirconia fibers may also be used to form the insulating gaskets. In the figure, reference numeral 14 signifies a piston ring and 18 a cover.

Figure 2:
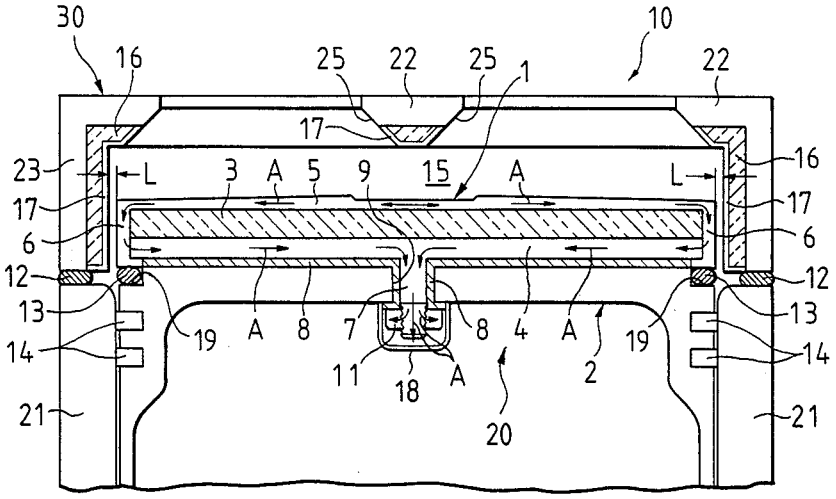
FIGS. 2 and 3 are explanatory drawings showing heat flow in the heat insulating engine of FIG. 1.
Figure 3:
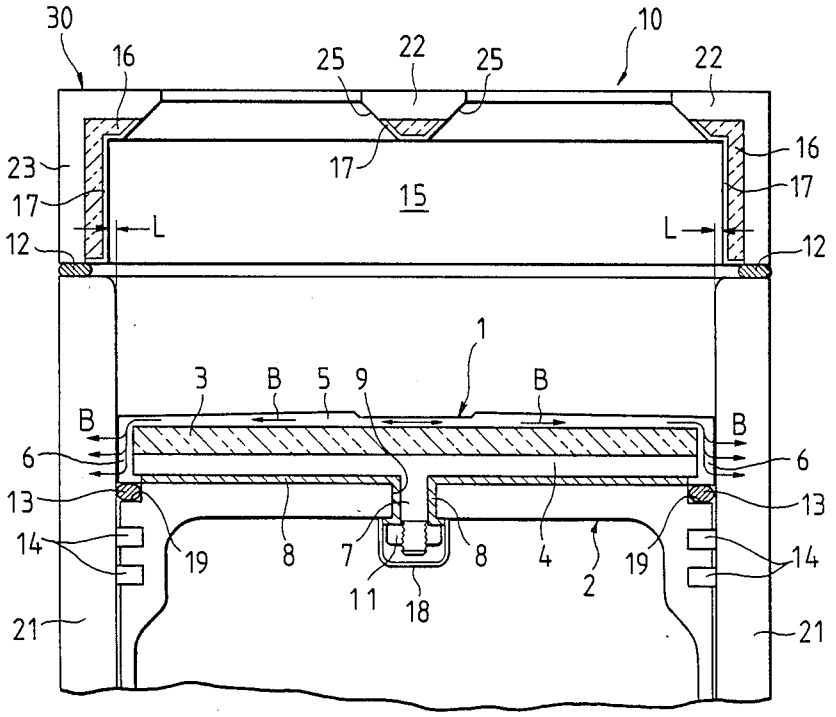
Figure 4:
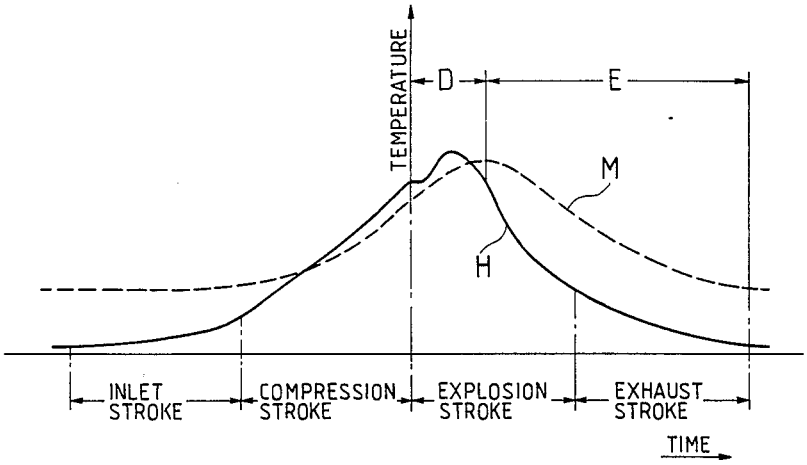
FIG. 4 is a graph showing the chronological temperature variations of the piston head.
Figure 5:
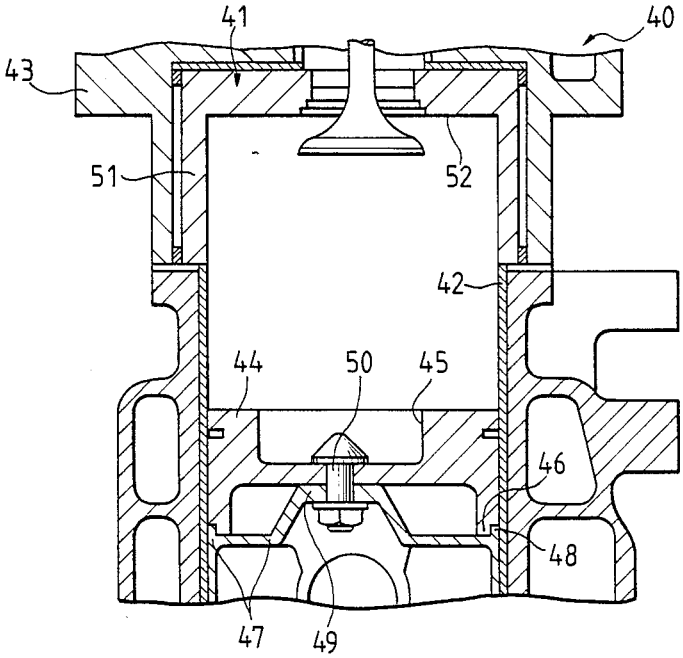
FIG. 5 PRIOR ART
FIG. 5 is a cross section showing one example of a conventional heat insulating engine.

Now, referring to FIGS. 2, 3 and 4, we will explain the action of the heat insulating engine 10 of this invention, i.e., the heat flow or heat dissipation process of the piston head 1. For the sake of simplicity, only the heat insulating portion is shown hatched and heat flow is indicated by arrows A and B in FIGS. 2 and 3.

FIG. 2 shows the piston 20 is raised and the piston head 1 positioned at the level of the cylinder liner upper portion 23. The thinned circular portion 6 along the circumference of the piston head 1 is not in contact with the heat insulating liner 17 of the cylinder liner upper portion 23, forming a gap L. This represents the condition at the end of the compression stroke when the piston 20 comes close to the top dead center and the gas temperature and pressure are very high. The combustion chamber 15 is surrounded, with heat insulated, by the heat insulating member 16 of the head-liner 30, the heat insulating gasket 8 and heat insulating member 3 of the piston head 1, the heat insulating gasket 12 between the cylinder liner upper portion 23 and the cylinder liner lower portion 21, and by the heat insulating gasket 13 between the piston head 1 and the piston skirt 2. The flow of thermal energy imparted to the piston head 1 is as follows. As shown by arrow A, heat is transferred via thinned plate portion 5 at the top of the piston head 1 and the thinned circular portion around its periphery, the retainer body 4, and its mounting boss 7 or nut 11. In such a condition, the combustion chamber 15 is almost heat-insulated, maintaining an ideal state as the heat insulating engine.

In FIG. 4, it is desired that, as shown by a solid line H, the engine maintain the heat-insulated condition for a duration D in power stroke and then release the accumulated heat for a duration E beginning at around the end of the power stroke and including exhaust stroke. With the construction of the heat insulating engine of this invention, the heat-insulated state is maintained during the power stroke and the temperature fall at the end of the power stroke and during the exhaust stroke is sufficiently large, bringing the temperature in the combustion chamber down to a desirable value, so that the air can be drawn into the combustion chamber maintained at an ideal temperature during the intake stroke. This is described in more detail as follows.

The amount of heat conducted Q is proportional to $$(T1\text{-}T2)\ S/d$$

(where $\alpha$: thermal conductivity, T1-T2: temperature difference between two points, S: heat conducting area, and d: thickness of a heat conducting member.)

The amount of heat transferred Qt is proportional to $$\alpha_g\,(T_G\text{-}T_W)\ S$$

(where S: surface area of a material, Qt: total amount of heat transferred through the surface area S, $\alpha_g$: heat transfer rate, and $T_G$-$T_W$ difference between gas temperature $T_G$ and wall temperature $T_W$.)

Therefore, when the piston head 1 is situated at the cylinder liner upper portion 23, the circumferential surface of the piston head 1 is not in contact with the wall surface of the cylinder liner upper portion 23, i.e., heat insulating liner 17, so that the heat flow will be as indicated by arrow A (see FIG. 2). In this state, the conducting surface S of the thinned ceramic portion of the piston head 1 (i.e., thinned plate portion 5 and thinned circular portion 6) is small and the thickness d is very large, which means that the amount of heat conducted Q is small. In other words, the amount of heat dissipated is small, maintaining a good heat-insulated state.

Next, as shown in FIG. 3, when after denotation the piston 20 moves down, the thinned circular portion 6 on the circumference of the piston head 1 comes into contact with the cylinder liner lower portion 21. That is, as the piston 20 reciprocates, the piston head 1 contacts the cylinder liner lower portion 21. When the thinned circular portion 6 of the piston head 1 contacts the cylinder liner lower portion 21, the heat energy given to the piston head 1 flows as shown by the arrow B. The heat is quickly released through thinned plate portion 5 at the top of the piston head 1 and the thinned circular portion 6 around the circumference of the piston head 1 and through the cylinder liner lower portion 21. In this way the heat imparted to the piston head 1 from the combustion chamber 15 is quickly released through the cylinder liner lower portion 21 immediately upon contact between the thinned circular portion 6 and the cylinder liner lower portion 21. As shown by the solid line H in FIG. 4, the temperature sharply decreases during the power stroke of the piston 20 and, during the exhaust stroke, falls to almost the same temperature as that of the cylinder liner lower portion 21, so that in the next intake stroke the air drawn in is not expanded by heat, thus preventing a reduction in the intake efficiency. The heat capacity of the thinned plate portion 5 and thinned circular portion 6 of the piston head 1 should be made as small as possible to reduce the amount of heat released to the cylinder liner lower portion 21 and thereby attain a sharp temperature reduction of the piston head 1.

In other words, when the piston head 1 is situated at the cylinder liner lower portion 21, the outer circumferential surface of the piston head contacts the cylinder liner lower portion 21 as it moves down the cylinder liner, with the heat flowing as indicated by the arrow B (see FIG. 3). As the piston moves down, the contacting surface S increases and since the difference between the gas temperature $T_G$ and the wall temperature $T_W$ is large, the amount of heat transferred Qt is large. Further, since the surface of the piston head 1 is formed thin to reduce the heat capacity, heat is rapidly and efficiently released via the cylinder liner. Therefore in the next intake stroke, fresh air is easily drawn into the combustion chamber 15, i.e., the air intake efficiency is not deteriorated.

In the heat insulating engine 10 of this invention which operates as mentioned above, the temperature of the piston head 1 exhibits ideal changes as the piston undergoes heat-insulating and heat-releasing processes. Since the wall of the piston head 1 facing the combustion chamber is formed as thin as possible to reduce the heat capacity, the heat can be quickly and reliably insulated when the heat insulation is most needed and it can be quickly and reliable released from the combustion chamber 15 when the temperature of the wall of the combustion chamber 15 has to be lowered to prevent a reduction in the air intake efficiency. This in turn allows the heat energy in the exhaust gas to be effectively recovered by an energy recovery equipment installed downstream of the heat insulating engine 10. The energy recovery equipment may include an exhaust turbine which is driven by hot exhaust gas from the engine to operate the air compressor for supercharging the engine and a generator to produce electricity.

What is claimed is:

1. A heat insulating engine comprising:

a head-liner formed, in one piece, of a ceramic material, the head-liner consisting of a head lower portion and a cylinder liner upper portion, the head lower portion having an intake port and an exhaust port;

a cylinder liner lower portion formed of ceramic material and having an inner diameter smaller than that of a combustion chamber formed by the head-liner, the cylinder liner lower portion being placed at the lower part of the cylinder with a heat insulating gasket interposed between it and the cylinder liner upper portion; and a piston reciprocating in the cylinder formed by the cylinder liner lower portion and the cylinder liner upper portion, the piston consisting of a piston skirt and a piston head secured to the piston skirt with a heat insulating gasket interposed therebetween, the piston head consisting of a retainer body secured to the piston skirt, a thinned ceramic circular portion around the circumference of the retainer body, a thinned plate portion formed integral with the thinned circular portion and exposed to burning gases in the combustion chamber, and a heat insulating member disposed in a space formed by the retainer body, the thinned plate portion and the thinned circular portion.

2. A heat insulating engine as set forth in claim 1, wherein the piston skirt has a mounting hole at the center and the retainer body has a mounting boss at the center that fits into the mounting hole of the piston skirt.

3. A heat insulating engine as set forth in claim 1, wherein the head-liner has a heat insulating member arranged on its inner circumferential surface and a heat insulating liner of ceramic material covering the heat insulating member and exposed to burning gases in the combustion chamber.

4. A heat insulating engine as set forth in claim 1, wherein during the reciprocating motion of the piston the outer circumferential surface of the thinned circular portion of the piston head does not contact the cylinder liner upper portion but contacts the cylinder liner lower portion.

5. A heat insulating engine as set forth in claim 1, wherein the thinned plate portion and thinned circular portion of the piston head are formed over the retainer body and the heat insulating member by chemical vapor deposition.

6. A heat insulating engine as set forth in claim 1, wherein the heat capacity of the thinned plate portion and thinned circular portion of the piston head is small.

7. A heat insulating engine as set forth in claim 1, wherein the thinned plate portion and thinned circular portion of the piston head are formed of silicon nitride.

8. A heat insulating engine as set forth in claim 1, wherein the thinned plate portion and thinned circular portion of the piston head are formed of silicon carbide.

9. A heat insulating engine as set forth in claim 1, wherein the retainer body of the piston head is formed of cermet which has a thermal expansion coefficient almost equal to that of ceramic material and has a high strength and a relatively high Young's modulus.

10. A heat insulating engine as set forth in claim 1, wherein the retainer body of the piston head is formed of a metal which has a thermal expansion coefficient almost equal to that of ceramic material and has a high strength and a relatively high Young's modulus.

11. A heat insulating engine as set forth in claim 1, wherein the heat insulating liner of the headliner is formed of silicon nitride.

12. A heat insulating engine as set forth in claim 1, wherein when, during the piston's reciprocating motion, the piston head is situated at the cylinder liner upper portion of the head-liner, with which it is not in contact, the heat imparted to the thinned plate portion of the piston head from the burning gas in the combustion chamber is released by conduction mainly through the thinned plate portion, the thinned circular portion, the retainer body and the mounting boss in that order.

13. A heat insulating engine as set forth in claim 1, wherein when, during the piston's reciprocating motion, the piston head is situated at the cylinder liner lower portion, with which the piston head is in contact, the heat imparted to the thinned plate portion of the piston head from the burning gas in the combustion chamber is released by conduction mainly through the thinned plate portion, the thinned circular portion, and the cylinder liner lower portion in that order.

14. A heat insulating engine as set forth in claim 1, wherein the retainer body surface facing the combustion chamber and the thinned plate portion are each formed flat.

15. A heat insulating engine as set forth in claim 1, wherein the head-liner is fitted in a recess formed in a cylinder head, which is made of a metal casting and has an intake port and an exhaust port.

* * * * *